United States Patent [19]

Killy

[11] Patent Number: 4,736,977

[45] Date of Patent: Apr. 12, 1988

[54] CROWN SUPPORT CARRIER

[75] Inventor: Earl J. Killy, Gainesville, Fla.

[73] Assignee: Manville Corporation, Denver, Colo.

[21] Appl. No.: 297,685

[22] Filed: Aug. 31, 1981

[51] Int. Cl.[4] ..... B65D 85/62; B65D 71/00

[52] U.S. Cl. ..... 294/87.2; 206/148; 206/158

[58] Field of Search ..... 294/87.2, 87.22, 87.26, 294/87.28; 206/427, 153, 158, 148, 151, 147, 194, 199, 429

[56] References Cited

U.S. PATENT DOCUMENTS 3,698,550 10/1972 Graser ..... 294/87.2

4,190,149 2/1980 Oliff et al. ..... 294/87.2

*Primary Examiner*—James B. Marbert

*Attorney, Agent, or Firm*—John D. Lister; Cornelius P. Quinn; Timothy R. Schulte

[57] ABSTRACT

A crown support carrier for a plurality of beverage bottles is disclosed. The carrier is designed for retaining bottles having circular flanges formed below the threaded necks of the bottles with the bottles being inserted through neck receiving openings in a flat center section of the carrier. A pair of upwardly and inwardly protruding panels are hingedly attached to opposite sides of the flat center section and serve to stiffen the carrier edge and to aid in the support of the bottles by being positioned at a pre-determined angle below the circular flanges. When so positioned, the upwardly protruding panels engage a portion of the circular flanges to thereby aid in carrying the bottle weight. The upwardly protruding panels also provide a flat graphic area for the placement of advertisments or other printed matter.

8 Claims, 2 Drawing Sheets

Fig. 1.
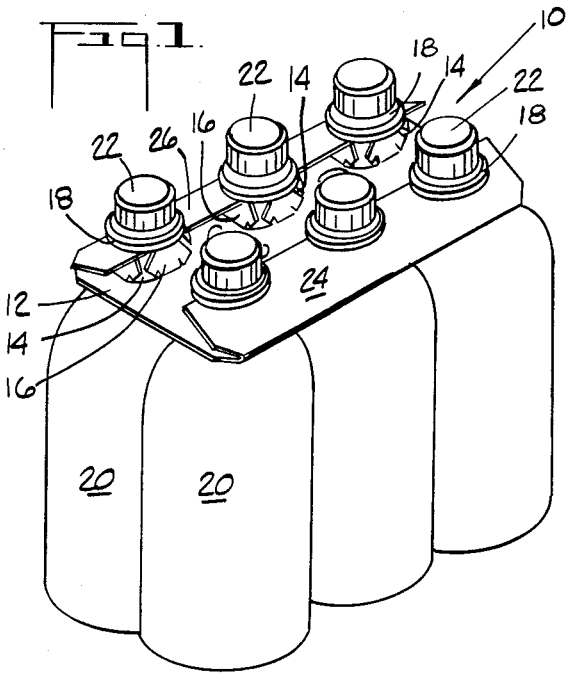
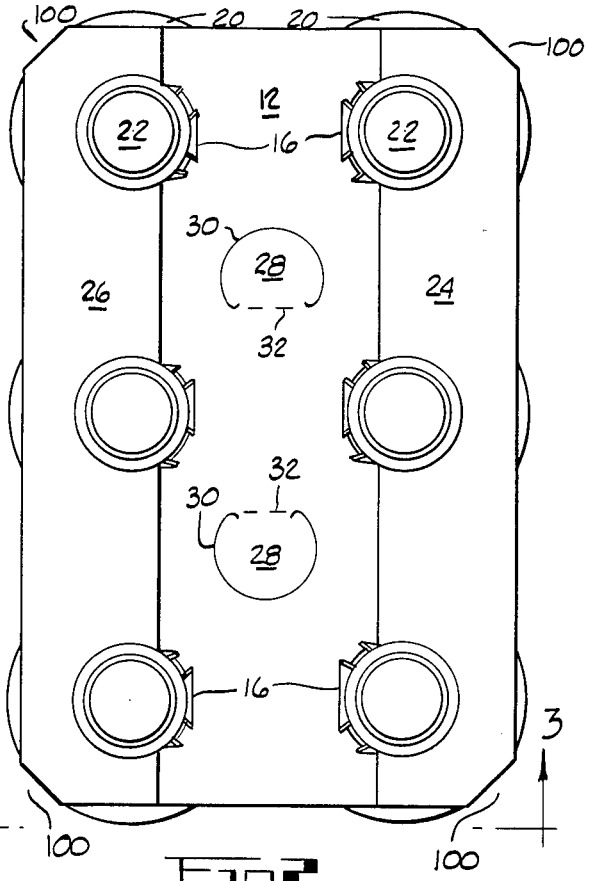
Fig. 2.
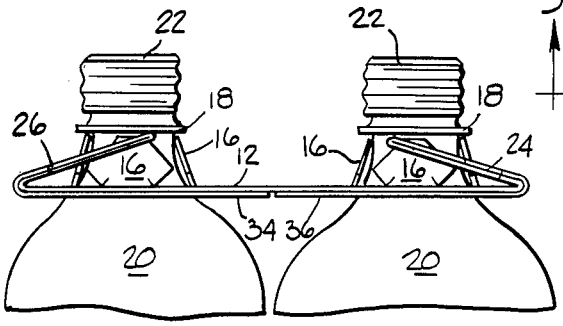
Fig. 3.
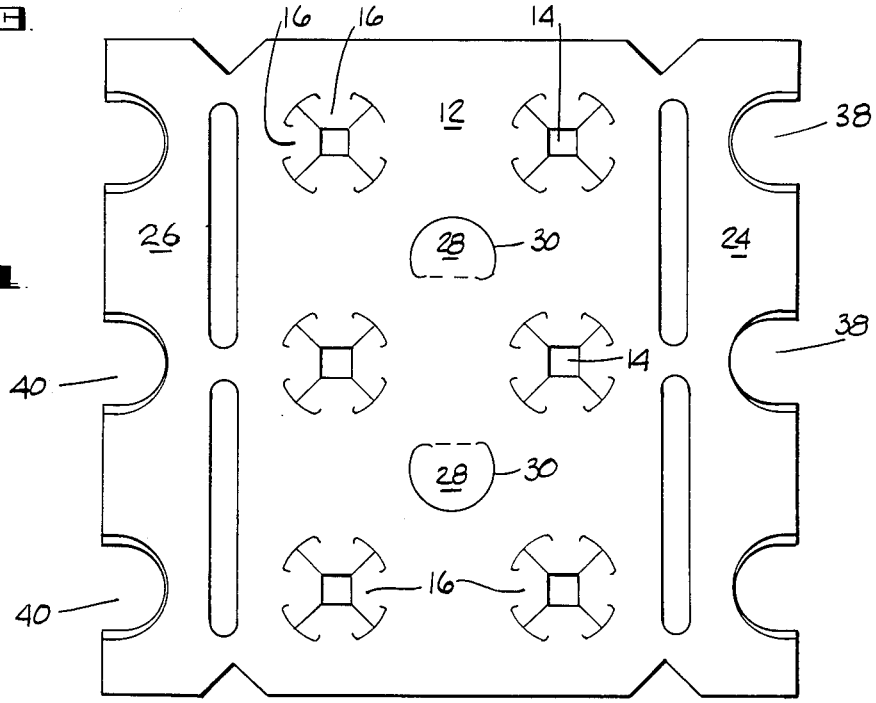
Fig. 4.

CROWN SUPPORT CARRIER

BACKGROUND OF THE INVENTION

This invention relates generally to a multiple article beverage carrier and more particularly relates to a new and improved crown support carrier formed of paperboard or the like and designed to be placed over the necks of the multiple articles contained in the carrier.

In the art of designing crown support carriers there has been provided a multitude of shapes designed to be able to support a plurality of beverage bottles by the necks of the bottles while providing a minimal amount of paperboard in the carrier in order to minimize overall packaging costs. With the advent of generic-style bottles, it is desirous to be able to have some advertising space available on the paperboard carrier. With the introduction of a plastic generic-style bottle, there has been also provided in the bottle structure a circular flange formed below the threaded neck of the bottle which is now available to the package designer as a means for retaining the bottle in the carrier.

One common problem in crown support carriers is to provide a stiffened carrier that does not sag or tend to sag whenever the consumer of the product transports the carrier using the available handle holes. The problem of carrier stiffness becomes more critical as the amount of paper in the carrier is minimized as beforementioned either by using smaller areas of paper or smaller thicknesses of paperboard in the construction of the carrier.

SUMMARY OF THE INVENTION

In order to overcome problems inherent in prior art designs and to provide a new and improved crown support carrier that is available for use on generic-style plastic bottles as well as others, there has been provided by the subject invention an improved crown support carrier which is designed for retaining bottles having circular flanges formed below the threaded necks of the bottles with the bottles being inserted through the neck receiving openings formed in a flat center section of the carrier. A pair of upwardly and inwardly protruding panels are hingedly attached to opposite sides of the flat center section and serve to stiffen the carrier and to aid in the support of the bottles by being positioned at a predetermined angle below the circular flanges of the bottles. When so positioned, the upwardly protruding panels engage a portion of the circular flanges to thereby carry some of the weight of the bottles in the carrier. A plurality of sunburst neck receiving appertures may also be incorporated into the carrier to further improve the bottle retaining ability of the carrier. The upwardly protruding panels also provide a flat graphic area for the placement of advertisements or other printed matter as desired by the purchaser of the package.

Accordingly, it is an object and advantage of the invention to provide an improved crown support carrier having minimal amounts of paperboard contained in the carrier and having improved stiffening qualities utilizing the minimal amounts of paperboard folded according to the embodiment of the invention.

Still yet another object and advantage of the invention is to provide an improved crown support carrier having improved graphic areas contained on the paperboard carrier for use with generic-style plastic bottles.

Still yet another object and advantage of the invention is to provide an improved crown support carrier having several means contained in the carrier for preventing bottles from dropping from the carrier during transportation.

These and other objects and advantages of the invention will become apparent from a review of the drawings and from a study of the preferred embodiment described hereinafter.

BRIEF DESCRIPTION OF THE DRAWINGS

FIG. 1 is a perspective view of the Applicant's new and novel crown support carrier showing a plurality of plastic-type generic bottles contained within the carrier;

FIG. 2 is a top plan view of the carrier shown in FIG. 1;

FIG. 3 is an end view, taken along line 3—3 of FIG. 2, showing the pair of upwardly and inwardly protruding panels positioned beneath the circular flanges on the bottles and also showing the plurality of sunburst neck receiving appertures contained in the central panel;

FIG. 4 is a top plan view of a folded carrier of the preferred embodiment showing the pair of protruding panels positioned and hingedly attached to the central panel.

DESCRIPTION OF THE PREFERRED EMBODIMENT

Figure 5:
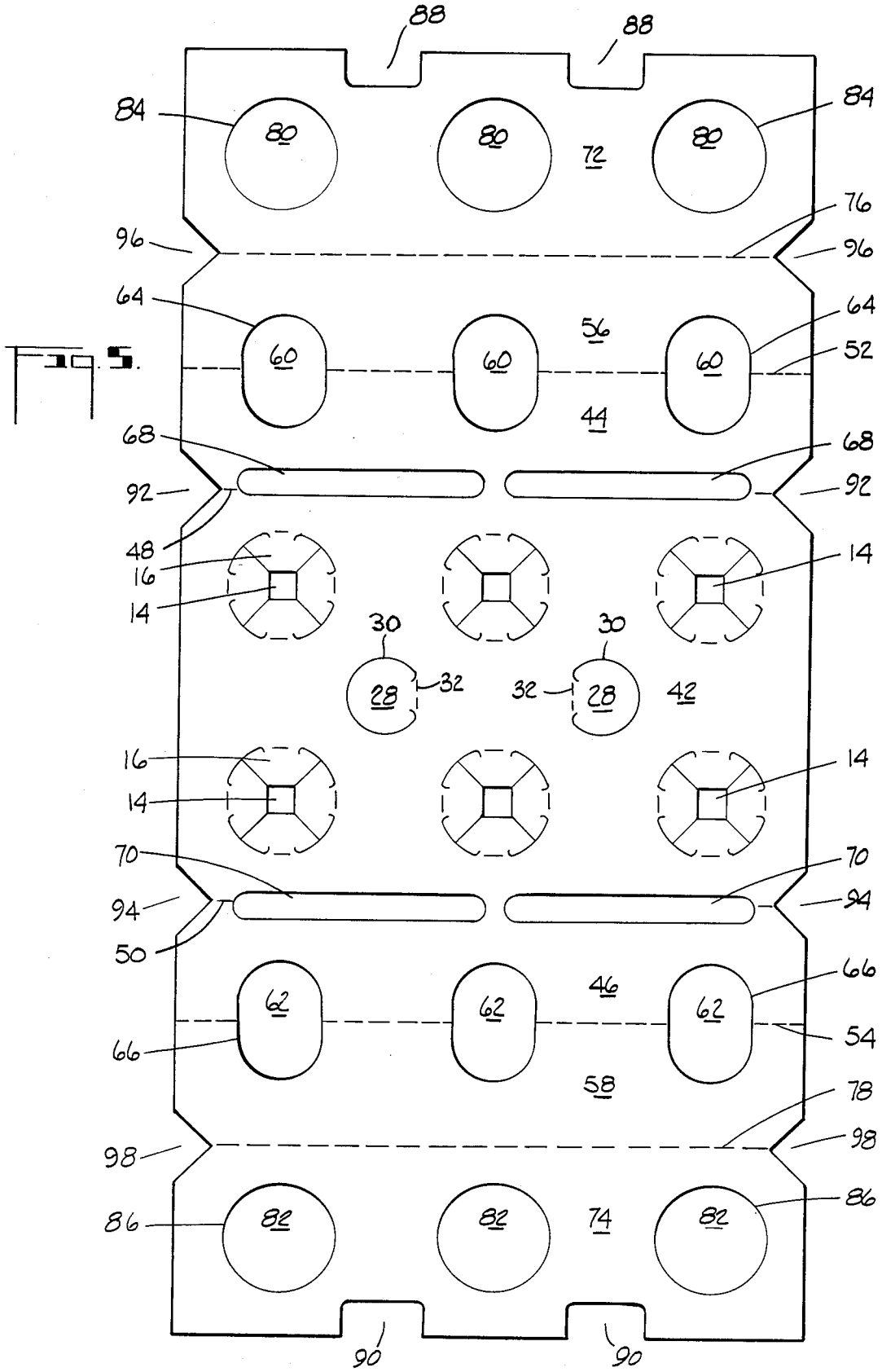
FIG. 5 is a top plan view of the production blank of the preferred embodiment crown support carrier showing the various protruding panels hingedly attached to the central panel and also showing the plurality of bottom panels hingedly attached to the protruding panel.

Referrring now to the drawings in general and in particular to FIG. 1 of the drawing, there is shown the Applicant's new and novel crown support carrier generally by the numeral 10 which comprises an elongated flat center section 12 having formed thereon a plurality of bottle neck receiving openings 14. The openings 14 may contain a plurality of sunburst apperature tabs 16 of the type known in the art and which are designed for positioning beneath the circular flange 18 of the bottle 20. A screw-on cap 22 is positioned over the top of the bottle 20 and provides the necessary gaseous seal to prevent the contents of the bottle from going flat.

The elongated flat center section 12 has hingedly attached thereto on opposite sides thereof, a pair of upwardly and inwardly protruding panels 24 and 26 which is designed to be positioned beneath the circular flanges 18 of the bottles 20. The protruding panels 24 and 26 contain a plurality of openings not clearly shown in FIG. 1 which allow the protruding panels to be positioned below the circular flanges 18. The plurality of openings are shown in FIG. 5 of the drawing and are numbered 60 and 62.

Referring now to FIG. 2 of the drawing, there is shown a top plan view of the Applicant's new and novel carrier shown in FIG. 1 and showing how the center section 12 contains a means for handling the carrier in the form of a pair of handle openings formed by a plurality of handle tabs 28 which are cut out of the center section 12 by means of the die cut 30. The purchaser of the crown support carrier simply pushes the handle tabs 28 downwardly whereby they are hinged along the score line 32 as is known in the art.

The upwardly and inwardly protruding panels 24 and 26 are designed to be at a predetermined angle below the circular flanges 18 and are designed to engage a portion of the flanges to thereby carry a portion of the weight of the beverage bottles and to provide a source of bottle drop-out prevention. The upwardly protruding panels 24 and 26 also serve to stiffen the paperboard carrier and serve as a means for providing a flat graphic surface upon which advertising or other printed material may be affixed.

Referring now to FIG. 3 of the drawing, there can be seen an end view, looking along line 3—3 of FIG. 2, showing how the preferred embodiment carrier shown in the drawings is manufactured from a single thickness of paperboard which is laminated to itself to provide a double thickness paperboard throughout the carrier. By referring to FIG. 3, it can be seen, for example, that the center section 12 is laminated to a bottom panel 34 and also to a bottom panel 36. These panels are hingedly attached to the protruding panels 24 and 26 which will be more clearly described when referring to the production blank shown in FIG. 5 of the drawing. In addition, it can be seen in FIG. 3 that the protruding panels 24 and 26 are double thickness in the preferred embodiment, thereby providing a much improved strengthened carrier made from a single piece of paperboard. It is within the spirit and scope of the invention, however, that the Applicant's new and novel crown support carrier could be made from a single thickness paperboard having heavier paper weight than the preferred embodiment which doubles the paper back on itself and laminates it to itself in order to provide double thickness.

Referring now to FIG. 4 of the drawing, there is shown a top plan view of the Applicant's new and novel crown support carrier showing the carrier folded and laminated to itself and prior to the protruding panels 24 and 26 being folded upwardly and locked to the circular flanges 18 and the bottles 20. By referring to FIG. 4, it can seen how the protruding panels 24 and 26 contain a plurality of cutouts 38 and 40 which have been described hereinbefore and which are designed to allow the protruding panels 24 and 26 to be easily positioned beneath the circular flanges 18.

Referring now to FIG. 5 of the drawing, there is shown a plan view of the production blank for the preferred embodiment of the Applicant's new and novel crown support carrier which comprises a central panel 42 having formed thereon a plurality of bottle neck receiving openings 14 as beforementioned. The openings 14 have formed therearound sunburst apperture tabs 16 for forming a secondary means of preventing bottle drop-out whenever the production blank is erected into a completed carrier and the carrier has a plurality of beverage bottles positioned therein. The number of sunburst apperture tabs 16 may vary according to the desires of the purchaser of the production blank and should be a minimum of two tabs and preferably three or four tabs as shown in FIG. 5. A pair of protruding panels 44 and 46 are hingedly attached to the flat central panel 42 by means of the score lines 48 and 50. In the preferred embodiment, the protruding panel 44 is scored, by the score line 52 and 54 to form a second protruding panel 56 and 58. The second protruding panel 56 and 58 are doubled back on the first protruding panels 44 and 46 and laminated thereto to provide double thickness construction in the protruding panel area.

Each protruding panel has a plurality of elongated neck receiving openings 60 and 62 as beforementioned and which are die cut by means of the die cuts 64 and 66 and removed from the production blank. A further elongated opening 68 and 70 is positioned between the protruding panels 44 and 46 on the score lines 48 and 50 to thereby aid in folding the erected carrier into the finished position.

Hingedly attached to the second protruding panel 56 and 58 are bottom panels 72 and 74 by means of the score line 76 and 78. The bottom panel 72 and 74 have formed therein a plurality of bottle neck receiving openings 80 and 82 formed by the die cuts 84 and 86 with the paperboard material being removed therefrom to provide the openings 80 and 82. Each bottom panel 72 and 74 also has formed thereon a plurality of open cut-outs 88 and 90 which are positioned beneath the handle tabs 28 whenever the carrier is completely erected and the bottom panel 72 and 74 are folded back and laminated to the underside of the central panel 42.

In order to provide the fully erected carrier with a somewhat rounded corner which is not sharp, there has been provided in the production blank a series of V-shaped cut-outs 92, 94, 96 and 98 on the various fold lines of the carrier to thereby provide the non-sharp corners at the ends of the erected carrier. For example, the score line 48 contains a pair of V-shaped cut-outs 92 while the score line 50 contains a pair of V-shaped cut-outs 94. In a similar manner, the score line 76 contains a pair of V-shaped cut-outs 96 and the score line 78 contains a pair of cut-outs 98. When the production blank shown in FIG. 5 is fully erected, it can be seen how the various cut-outs 92, 94, 96 and 98 cooperate to form the cut-off corners of the package as shown in FIG. 2 and as designated by the numeral 100.

When erecting the carrier production blank shown in FIG. 5, the second protruding panel 56 would be folded about the score line 52 and laminated to the first protruding panel 44 with the bottom panel 72 being laminated to one half of the central panel 42. In a like manner, the second protruding panel 58 would be folded about the score line 54 and laminated to the first protruding panel 46 with the bottom panel 74 being laminated to the other half of the central panel 42. When formed thusly, it can be seen that the one-piece production blank can be formed into a double thickness laminated paperboard carrier to thereby provide added support to the bottles especially when the protruding panels 44, 56, 46 and 58 are folded upwardly and inwardly and are locked under the circular flanges 18 of the bottles 20.

From the foregoing, it can be seen that there has been provided by the subject invention a new and novel crown support carrier having novel features hereinbefore unknown in the art. It is within the spirit and scope of the invention that changes may be made in the particular carrier and the arrangement of the various parts of the carrier and its panels and score lines and the like without departing from the spirit and scope of the invention. The invention is not to be limited to the exact carrier shown and described which has been given by way of illustration only.

Having described my invention, I claim:

1. A crown support carrier for a plurality of beverage bottles and designed for positioning beneath the necks of circular flanges formed below the threaded necks of the beverage bottles, comprising:

(a) an elongated flat center section having formed thereon a plurality of bottle neck receiving openings, said openings having means to provide bottle drop-out prevention;

(b) a pair of upwardly and inwardly protruding panels forming stiffening sections hingedly attached to opposite sides of the center section;

(1) a plurality of neck receiving generally U-shaped cut-outs formed in each protruding panel which open inwardly for positioning beneath those portions of the circular flanges on the beverage bottles facing the sides of the center section;

(2) the upwardly and inwardly protruding panels and the neck receiving cut-outs being designed to be positioned at a pre-determined angle below the circular flanges and to engage said portions of the flanges to thereby carry a portion of the weight of the beverage bottles positioned within the carrier and provide a source of bottle drop-out prevention, the upwardly protruding panels also serving to provide a flat graphic surface upon which advertising may be printed; and (c) means, formed on the center section, for handling the carrier.

2. The crown support carrier as defined in claim 1 further comprising the carrier being formed from a single thickness paperboard laminated to itself to thereby provide double thickness paperboard throughout substantially the entire carrier.

3. The crown support carrier as defined in claim 1 further comprising the handle means comprising a pair of handle openings positioned in the central portion of the center section.

4. The crown support carrier as defined in claim 1 wherein said opening means to provide bottle drop-out prevention comprises a plurality of sunburst apperture tabs being formed around the circumference of the bottle neck receiving openings.

5. The production blank for a crown support carrier for a plurality of beverage bottles having circular flanges on their necks comprising:

(a) a flat center panel having formed thereon a plurality of bottle neck receiving openings, said openings each having means to provide bottle drop-out prevention when the production blank is erected into a completed carrier and the carrier has a plurality of beverage bottles positioned therein, and said flat center panel having formed thereon means for handling the erected crown support carrier;

(b) a pair of protruding panels hingedly attached to the flat center panel and having formed therein a plurality of elongated neck receiving openings, each protruding panel being scored transversely through the center of the elongated neck receiving openings for;

(1) folding the protruding panel in half to form said neck receiving openings into generally U-shaped cut-outs for positioning beneath those portions of the circular flanges of beverage bottles facing the sides of the center panel when the production blank is erected into a completed carrier and the carrier has a plurality of beverage bottles positioned therein; and (2) laminating it to itself and to the underside of the center panel whenever the completed carrier is fully erected; and (c) a bottom panel hingedly attached to each protruding panel and having formed therein a plurality of bottle neck receiving openings, the bottom panels being designed for folding about the hinge line where they are attached to the adjacent protruding panel and being designed for adhesively being secured to the underside of the flat center panel.

6. The production blank as defined in claim 5 further comprising each bottom panel having formed therein a plurality of open cut-outs on the outer edge of the bottom panel for positioning beneath the handle means formed in the center section of the carrier.

7. The production blank as defined in claim 5 wherein said means to provide bottle drop-out prevention in said openings formed in said flat center panel comprises sunburst apperture tabs for forming a secondary means of preventing bottle drop-out whenever the production blank is erected into a completed carrier and the carrier has a plurality of beverage bottles positioned therein.

8. The production blank as defined in claim 5 further comprising a plurality of elongated appertures formed along the hinge line separating the center panel from the adjacent protruding panels to thereby aid in folding the erected carrier into a finished position.

* * * * *

UNITED STATES PATENT AND TRADEMARK OFFICE

CERTIFICATE OF CORRECTION

PATENT NO. : 4,736,977

DATED : April 12, 1988

INVENTOR(S) : Earl J. Killy

It is certified that error appears in the above—identified patent and that said Letters Patent is hereby corrected as shown below:

Column 6, line 1 should read:

center panel having formed thereon handle opening means for

Signed and Sealed this

Twentieth Day of September, 1988

*Attest:*

DONALD J. QUIGG

*Attesting Officer*

*Commissioner of Patents and Trademarks*